US009487220B1

(12) United States Patent
Donnan

(10) Patent No.: US 9,487,220 B1
(45) Date of Patent: Nov. 8, 2016

(54) REVERSER HANDLE AND METHOD OF USE

(71) Applicant: Railhead Corporation, Alsip, IL (US)

(72) Inventor: Joseph Donnan, Oak Lawn, IL (US)

( * ) Notice: Subject to any disclaimer, the term of this patent is extended or adjusted under 35 U.S.C. 154(b) by 749 days.

(21) Appl. No.: 13/733,303

(22) Filed: Jan. 3, 2013

Related U.S. Application Data

(60) Provisional application No. 61/582,899, filed on Jan. 4, 2012.

(51) Int. Cl.
*B61C 17/12* (2006.01)

(52) U.S. Cl.
CPC ..... *B61C 17/12* (2013.01)

(58) Field of Classification Search
CPC ..... B61C 17/12; B60L 15/20; G05G 9/08; B63H 21/213
USPC ..... 246/55; 74/523
See application file for complete search history.

(56) References Cited

U.S. PATENT DOCUMENTS

| | | | | |
|---|---|---|---|---|
| 1,705,069 | A * | 3/1929 | Saurman | E05B 17/106 16/DIG. 30 |
| 4,637,668 | A | 1/1987 | Kleffman et al. | |
| 5,542,891 | A | 8/1996 | Kettle, Jr. et al. | |
| 5,552,761 | A * | 9/1996 | Kazyaka | F16H 63/42 116/28.1 |
| 6,930,594 | B1 * | 8/2005 | Wang | B60Q 1/1476 200/43.17 |

* cited by examiner

*Primary Examiner* — Thomas Diaz
(74) *Attorney, Agent, or Firm* — Doherty, Wallace, Pillsbury & Murphy, PC

(57) ABSTRACT

A reverser handle comprising a key component integrally associated with a light component. In an exemplary embodiment, the light component comprises a cap which houses a light source, such as, e.g., a plurality of light emitting diodes, a light bulb, or a photoluminescent material which allows the cap to glow in the dark. The key component which comprises a body having extending therefrom a flange which is configured to actuate a control stand. In another exemplary embodiment, a reverser handle comprises a key component comprising a body having extending therefrom a flange which is configured to be received within the control stand, and which is further configured such that the key component cannot actuate the control stand. The light component preferably comprises a blue light emitting light source to comply with a blue flag safety procedure.

16 Claims, 3 Drawing Sheets

REVERSER HANDLE AND METHOD OF USE

BACKGROUND OF THE INVENTION

1. Field of the Invention

The present disclosure relates generally to reverser handles, and, more particularly, to a reverser handle that emits light and to a method of use.

2. Background of the Invention

A reverser handle, which is commonly referred to as a "railroad key" is an operating control for a railroad locomotive that is used to determine the direction of travel. The reverser usually has three positions: forward, reverse, and neutral. When the reverser is in the forward or reverse position, the locomotive will move in the indicated direction when the throttle is opened. Removing the reverser handle from the control stand-in the neutral position locks the throttle controller, effectively disabling the locomotive. Oftentimes reverser handles are handled in dimly lit environments, making it difficult to see where precisely the reverser handle fits in the control stand. Accordingly, it would be useful to have a reverser handle integrated with a light emitting member thereby enhancing an operator's visibility so that the operator can accurately position the reverser handle in the locomotive's control stand.

In an alternative embodiment, the present invention is designed to overcome another problem frequently encountered in the railroad industry. A safety concern on railroads is injury caused by an engineer moving a locomotive without knowing there are others inspecting or repairing the locomotive. Railroad companies have implemented a Blue Flag safety procedure to prevent such an occurrence. Presently, an operator working on a locomotive is required to place a blue flag in the locomotive's cab. No one is permitted to move any locomotive tagged in this manner. Unfortunately, this does not always protect against poorly trained or careless operators, or just plain human error. Accordingly, what is needed is a device that can integrate the blue flag safety requirement with a key that can fit within the control stand but which is non-functional in the sense that it does not turn the locomotive on.

BRIEF SUMMARY OF THE INVENTION

The above described deficiencies of the prior art are cured or alleviated by a reverser handle that is integrated with a light emitting component. In a first exemplary embodiment, the reverser handle comprises a key component integrally associated with a light component. The light component comprises a cap which houses a light source. An exemplary light source includes, e.g., light emitting diodes, a light bulb, a photoluminescent material, and the like. The key component may comprise a body having extending therefrom a flange which is configured to actuate a control stand.

In a second exemplary embodiment, a reverser handle comprises a key component integrally associated with the light component as described above with reference to the first exemplary embodiment. The key component comprises a body having extending therefrom a flange which is configured to be received within the control stand, and which is further configured such that the key component cannot actuate the control stand. The light component, which is physically engaged with the key component, preferably comprises a blue light emitting light source. In this embodiment, then, the reverser handle serves as an improved, effective, and reliable locomotive safety device for enforcing the blue flag rule and including the preliminary step of warning would be operators that the locomotive is classified in the "blue flag" condition and should not be moved, and, making it thereafter impossible for such warned operators to in fact initiate locomotive movement.

These and other features and advantages of the present invention will be more fully understood from a reading of the following detailed description with reference to the accompanying drawings.

DETAILED DESCRIPTION OF THE INVENTION

Figure 1:
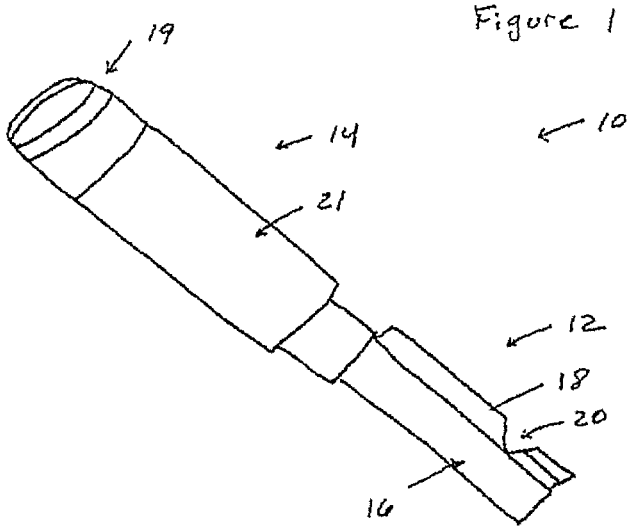
FIG. 1 is a schematic depicting an exemplary reverser handle.

Referring to FIG. 1, in an exemplary embodiment, the reverser handle of the present invention provides a means whereby a specially configured reverser handle is integrated with a light emitting component. Here, a reverser handle 10 comprises a key component 12 integrally associated with a light component 14. Key component 12 comprises a longitudinally extending body 16 from which a flange 18 axially extends. Flange 18 has a notch 20 formed therein which is configured to be received by a locomotive's control stand and which serves to actuate the control stand, wherein an exemplary control stand is conventionally known.

Figure 2:
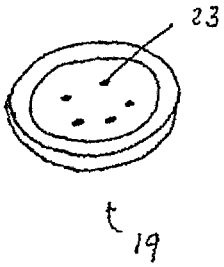
FIG. 2 is a schematic depicting an exemplary light emitting component.

Light component 14 comprises a cap 19 receivably engaged with a sleeve 21, wherein sleeve 21 is integrally formed with longitudinally extending body 16. Cap 19 contains a light emitting component which comprises a plurality of light emitting diodes 23, as more specifically shown in FIG. 2. Although the light emitting component depicted in FIGS. 1 and 2 comprises plurality of light emitting diodes 23, it is contemplated that the light emitting component may further or alternatively comprise, e.g., a light bulb or other light emitting source. Sleeve 21 may house a power source, such as, e.g., a battery, which is in electrical communication with the light emitting component and which is used to power the light emitting component. In an exemplary embodiment, cap 19 may be rotated in one direction to actuate the light emitting component, and rotated in an opposite direction to place the light emitting component in a deactivated, or an "off" position.

Figure 3:
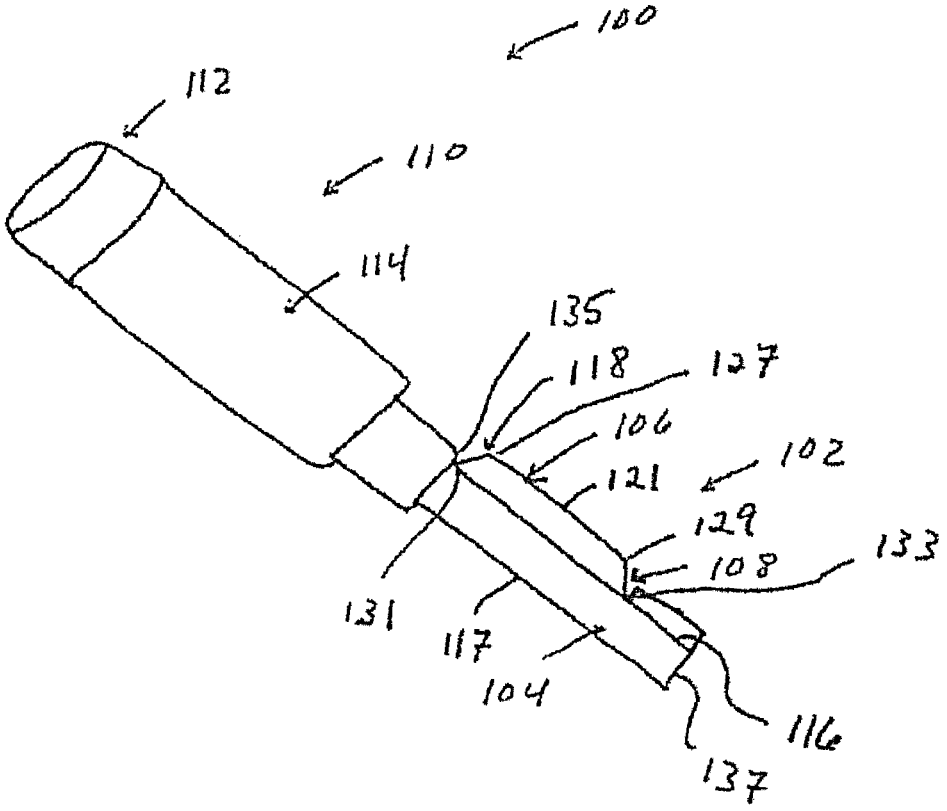
FIG. 3 is a schematic depicting another exemplary reverser handle.

Referring to FIG. 3, in another exemplary embodiment, a reverser handle 100 comprises a light emitting component that preferably emits a blue-colored light to satisfy blue flag safety requirements. Reverser handle 100 comprises a key component 102 comprising a longitudinally extending body 104 having a top side 116 oppositely situated to a bottom side 117, and an anterior terminal end 135 oppositely situated to a posterior terminal end 137. A flange 106 axially extends from top side 116 and is contiguously formed therewith. Flange 106 is configured such that key component 102 is received by and held within the locomotive control stand, and further such that key component 102 cannot actuate the control stand when key component 102 is received by and held within the locomotive control stand. To that end, e.g., flange 106 comprises an anterior terminal end 118 oppositely situated to a posterior terminal end 108. Each of anterior and posterior terminal ends 118 and 108 respectively comprises an upper end 127 and 129 oppositely situated to a lower end 131 and 133. Upper ends 127 and 129 are contiguously formed with and joined to a planar top side 121 of flange 106. Additionally, lower ends 131 and 133 are contiguously formed with and are joined to top side 116 of longitudinally extending body 104. Posterior terminal end 108 continuously slopes downwards from upper end 129 to lower end 133.

Reverser handle 100 further comprises a light component 110 which comprises a cap 112 receivably engaged with a sleeve 114, wherein sleeve 114 is integrally formed with body 104. Cap 112 contains a light emitting component, such as, for example a light emitting diode, a light bulb, and the like, wherein the light emitting component emits a blue-colored light. Sleeve 114 houses a power source, such as, e.g., a battery, which is in electrical communication with the light component, and which is used to power the light emitting component. In an exemplary embodiment, cap 112 may be rotated in one direction to actuate the light emitting component, and rotated in an opposite direction to place the light emitting component in a deactivated, or an "off" position.

Accordingly, when reverser handle 100 is positioned within the control stand, it may be actuated by, for example, rotating cap 112. Once actuated, the light emitting component emits a blue-colored light in the region of the control stand, thereby satisfying the blue flag rules. Additionally, reverser handle 100 acts as a safety feature, as key component 102 is configured such that it can fit within the control stand, but it cannot activate motion of the locomotive. Accordingly, to initiate movement, reverser handle 100 would need to be removed from the control stand, and a functional reverser handle would need to be properly inserted within the control stand.

Figure 4:
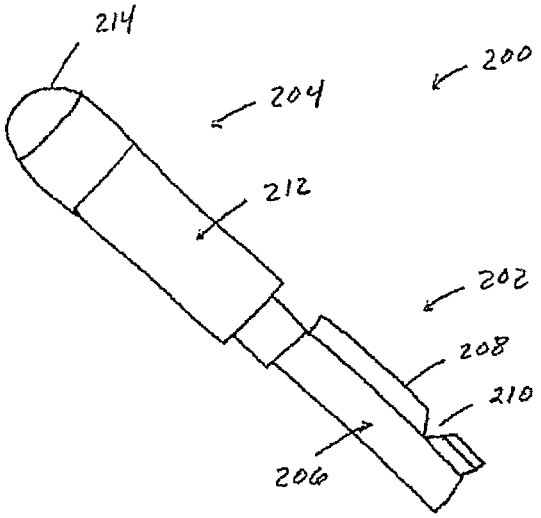
FIG. 4 is a schematic depicting another exemplary reverser handle.

Referring to FIG. 4, in another exemplary embodiment, a reverser handle 200 comprises a key component 202 integrally associated with a light component 204. Key component 202 comprises a longitudinally extending body 206 from which a flange 208 axially extends. Flange 208 has a notch 210 formed therein which is configured to be received by a locomotive's control stand and which actuates the control stand. Light component 204 comprises a longitudinally extending member 212 which is integrally engaged with body 206. Light component 204 further comprises a cap 214 disposed atop longitudinally extending member 212. Cap 214 contains a photoluminescent material that glows in the dark. In an exemplary embodiment, the photoluminescent material comprises a phosphorescent, which may comprise, for example, zinc sulfide, strontium aluminate, and the like. Alternatively, the photoluminescent material may comprise a radioactive isotope combined with a phosphor, wherein the radioactive isotope may include, for example, radium, tritium, promethium, and the like.

Therefore, reverser handle 200 provides another means whereby a reverser handle can provide a light source to ease visibility in dimly lit and/or dark environments. However, unlike reverser handle 10, reverser handle 200 does not require an electrical power source.

While the disclosure has been shown and described with reference to certain preferred embodiments thereof, it will be understood by those skilled in the art that various changes in form and detail may be made therein without departing from the spirit and scope of the disclosure.

What is claimed is:

1. A reverser handle comprising:
- a key component comprising:
  - a longitudinally extending body having a top side oppositely situated to a bottom side, and an anterior terminal end oppositely situated to a posterior terminal end; and
  - a flange axially disposed on the longitudinally extending body, wherein the flange comprises:
    - a planar top side; and
    - an anterior terminal end oppositely situated to a posterior terminal end,
  - wherein each of the anterior and posterior terminal ends respectively comprises an upper end and a lower end;
- wherein the upper ends of each of the anterior and posterior terminal ends are contiguously formed with and are joined to the planar top side, and wherein the lower ends of each of the anterior and posterior terminal ends are contiguously formed with and are joined to the top side of the longitudinally extending body such that the planar top side of the flange is raised relative to the longitudinally extending body; and
- a light component attached towards the anterior terminal end of the longitudinally extending body, wherein the light component comprises:
  - a light emitting component;
  - a cap, wherein the cap holds the light emitting component; and
  - a longitudinally extending sleeve member disposed between the cap and the longitudinally extending body of the key component, and which joins the cap to the longitudinally extending body.

2. The reverser handle of claim 1, wherein the longitudinally extending sleeve member holds a power source which is in electrical communication with the light emitting component.

3. The reverser handle of claim 2, wherein the power source comprises a battery.

4. The reverser handle of claim 3, wherein rotation of the cap relative to the longitudinally extending sleeve member actuates the light emitting component.

5. The reverser handle of claim 2, wherein the light emitting component comprises a plurality of light emitting diodes.

6. The reverser handle of claim 5, wherein the plurality of light emitting diodes emits a blue colored light.

7. The reverser handle of claim 1, wherein the light emitting component comprises a photoluminescent material.

8. The reverser handle of claim 7, wherein the photoluminescent material emits a blue colored light.

9. A method of warning an operator that a locomotive is being serviced or inspected, comprising:
- providing a reverser handle, wherein the reverser handle comprises:
  - a key component comprising:
    - a longitudinally extending body having a top side oppositely situated to a bottom side, and an anterior terminal end oppositely situated to a posterior terminal end; and
    - a flange axially disposed on the longitudinally extending body, wherein the flange comprises:
      - a planar top side; and
      - an anterior terminal end oppositely situated to a posterior terminal end, wherein each of the anterior and posterior terminal ends respectively comprises an upper end and a lower end;

wherein the upper ends of each of the anterior and posterior terminal ends are contiguously formed with and are joined to the planar to side, and wherein the lower ends of each of the anterior and posterior terminal ends are contiguously formed with and are joined to the top side of the longitudinally extending body such that the planar top side of the flange is raised relative to the longitudinally extending body; and a light component attached towards the anterior terminal end of the longitudinally extending body, wherein the light component comprises:

a light emitting component;

a cap, wherein the cap holds the light emitting component; and a longitudinally extending sleeve member disposed between the cap and the longitudinally extending body of the key component, and which loins the cap to the longitudinally extending body;

inserting the flange of the key component into a key hole of the locomotive's control stand; and actuating the light emitting component.

10. The method of claim 9, wherein the light emitting component comprises a photoluminescent material.

11. The method of claim 10, wherein the photoluminescent material comprises a phosphorescent.

12. The method of claim 11, wherein the light emitting component emits a blue colored light.

13. The method of claim 9, wherein the sleeve holds a power source, wherein the power source is in electrical communication with the light emitting component.

14. The method of claim 13, wherein the light emitting component emits a blue light.

15. The method of claim 14, wherein the light emitting component comprises a plurality of light emitting diodes.

16. A reverser handle, comprising:

a key component, comprising:

a means for engaging the reverser handle with a locomotive control stand; and a means for preventing the key component from actuating the locomotive control stand when the means for engaging the reverser handle with the locomotive control stand is engaged with the locomotive control stand;

a cap comprising a means for emitting light; and a sleeve in physical communication with the cap and with the key component, and further in electrical communication with the cap, wherein the sleeve comprises a means for providing power to the means for emitting light from the cap.

* * * * *